US010020093B2

(12) United States Patent
Oshiumi

(10) Patent No.: US 10,020,093 B2
(45) Date of Patent: Jul. 10, 2018

(54) TERMINAL-EQUIPPED COATED WIRE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Naoyuki Oshiumi, Mie (JP)

(73) Assignees: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/545,832

(22) PCT Filed: Jan. 8, 2016

(86) PCT No.: PCT/JP2016/050408
§ 371 (c)(1),
(2) Date: Jul. 24, 2017

(87) PCT Pub. No.: WO2016/121441
PCT Pub. Date: Aug. 4, 2016

(65) Prior Publication Data

US 2018/0019040 A1 Jan. 18, 2018

(30) Foreign Application Priority Data

Jan. 29, 2015 (JP) ..... 2015-015276

(51) Int. Cl.
*H01B 7/00* (2006.01)
*H01B 7/28* (2006.01)
(Continued)

(52) U.S. Cl.
CPC ..... *H01B 7/2806* (2013.01); *H01B 1/023* (2013.01); *H01B 7/0045* (2013.01); *H01R 4/185* (2013.01); *H01R 4/62* (2013.01); *H01R 4/70* (2013.01)

(58) Field of Classification Search
CPC .. H01B 7/2806; H01R 4/185; B60R 16/0215; C08L 9/02
(Continued)

(56) References Cited

U.S. PATENT DOCUMENTS 8,951,063 B2 * 2/2015 Iio ..... H01R 13/5216 439/523
9,627,103 B2 * 4/2017 Rachi ..... H01B 7/2806
(Continued)

FOREIGN PATENT DOCUMENTS

JP 2011238500 A 11/2011
JP 2013251166 A 12/2013
JP 2014186801 A 10/2014

OTHER PUBLICATIONS

International Search Report for Application No. PCT/JP2016/050408 dated Apr. 5, 2016, 5 pages.
(Continued)

*Primary Examiner* — Hae Moon Hyeon
(74) *Attorney, Agent, or Firm* — Reising Ethington, P.C.

(57) ABSTRACT

A terminal-equipped coated wire having an exposed conductor portion at an end portion of a coated wire in which a conductor is coated with a coating material, a terminal fitting—connected to the conductor at the exposed conductor portion, and an anticorrosive agent with which a contact portion between the conductor and the terminal fitting is sealed, wherein an anticorrosive agent which is composed of a cured product of a curable resin and in which the cured
(Continued)

product has a crosslink density within a range of $0.6\times10^{-5}$ to $4\times10^{-4}$ (mol/cm$^3$) is used as the anticorrosive agent.

5 Claims, 4 Drawing Sheets

(51) Int. Cl.
*H01B 1/02* (2006.01)
*H01R 4/70* (2006.01)
*H01R 4/18* (2006.01)
*H01R 4/62* (2006.01)

(58) Field of Classification Search
USPC ..... 174/72 A, 74 R; 252/396, 392
See application file for complete search history.

(56) References Cited

U.S. PATENT DOCUMENTS

2012/0199391 A1* 8/2012 Inoue ..... H01B 7/2806 174/72 A
2012/0205151 A1* 8/2012 Inoue ..... C09D 5/082 174/72 A
2013/0032394 A1* 2/2013 Inoue ..... C09D 5/08 174/74 R
2013/0052887 A1* 2/2013 Inoue ..... H01R 4/70 439/877
2013/0056266 A1* 3/2013 Inoue ..... C09D 5/08 174/72 A
2013/0062114 A1* 3/2013 Inoue ..... C09D 4/00 174/72 A
2013/0098679 A1* 4/2013 Takata ..... C08L 23/26 174/74 R
2015/0368389 A1* 12/2015 Tanaka ..... C09D 4/06 174/72 A
2016/0006233 A1* 1/2016 Oshiumi ..... H01B 7/2806 174/76
2016/0012943 A1* 1/2016 Rachi ..... H01B 7/2806 174/72 A

OTHER PUBLICATIONS

International Preliminary Report on Patentability for Application No. PCT/JP2016/050408, 6 pages.

* cited by examiner

TERMINAL-EQUIPPED COATED WIRE

CROSS REFERENCE TO RELATED APPLICATIONS

This application claims the priority of Japanese patent application JP2015-015276 filed on Jan. 29, 2015, the entire contents of which are incorporated herein.

TECHNICAL FIELD

The present invention relates to a terminal-equipped coated wire and a wire harness using the same, and more particularly relates to a terminal-equipped coated wire and a wire harness in which an electrical connection portion between a conductor and a terminal fitting has excellent anti-corrosion properties.

BACKGROUND ART

In recent years there has been a growing trend to improve fuel efficiency of a vehicle such as an automobile by reducing the weight thereof, and accordingly, weight reduction of a wire material constituting a wire harness is also demanded. Thus, the use of aluminum for a conductor has been studied.

However, for terminal fittings, generally, copper or a copper alloy, which has excellent electrical characteristics, is used. Therefore, a combination of an aluminum wire and a copper terminal fitting, or the like is often used. When a conductor and a terminal fitting are made of different materials, corrosion due to contact between dissimilar metals occurs at an electrical connection portion therebetween. This type of corrosion is more likely to occur compared with the case where the conductor and the terminal fitting are made of the same material. Thus, an anticorrosive agent capable of reliably preventing corrosion of the electrical connection portion is necessary.

In order to prevent corrosion at the above-described electrical connection portion, for example, a technique of sealing an exposed portion of a conductor (core wire) at a leading end portion of an aluminum wire by using a silicon resin or an acrylic resin is known from Patent Document 1 (JP 2011-238500A).

SUMMARY

However, during use in an in-vehicle environment, if oil, such as engine oil, adheres to the portion sealed with the above-described conventional anticorrosive agent, a film of the anticorrosive agent absorbs the oil and may deteriorate, or the adhesiveness between the anticorrosive agent and the conductor or the terminal may deteriorate. Thus, there is concern that sufficient anti-corrosion performance cannot be exhibited due to the oil.

To address the above-described problem with related art, an object of the present application is to provide a terminal-equipped coated wire and a wire harness in which the risk of the anti-corrosion performance of an anticorrosive agent deteriorating due to the adhesion of oil or other causes is eliminated, and a wire connection portion has excellent anti-corrosion performance.

To address the above-described problem, a terminal-equipped coated wire of the present application essentially is a terminal-equipped coated wire including:

an exposed conductor portion at an end portion of a coated wire in which a conductor is coated with a coating material, the coating material being peeled off and the conductor being exposed at the exposed conductor portion;

a terminal fitting connected to the conductor at the exposed conductor portion; and an anticorrosive agent with which a contact portion between the conductor and the terminal fitting is sealed, wherein the anticorrosive agent is composed of a cured product of a curable resin, the cured product having a crosslink density within a range of $0.6\times10^{-5}$ to $4\times10^{-4}$ (mol/cm$^3$), and the crosslink density is obtained by measuring an equilibrium modulus of elasticity from a dynamic viscoelasticity of the cured product and calculating an equation (1) below:

$$\rho=E/(3RT) \quad (1)$$

in the equation (1), ρ represents the crosslink density (mol/cm$^3$), E represents a modulus of elasticity (MPa), R represents a gas constant (8.31 J/mol·k), and T represents an absolute temperature (K).

In the terminal-equipped coated wire of the present application, it is preferable that the cured product has a tensile shear adhesive strength to a metal of 0.5 MPa or more after an oil resistance test.

In the terminal-equipped coated wire of the present application, it is preferable that the curable resin is an ultraviolet curable acrylic resin.

In the terminal-equipped coated wire of the present application, it is preferable that the terminal fitting is made of a copper material whose surface is plated with tin.

In the terminal-equipped coated wire of the present application, it is preferable that the conductor has an elemental wire made of an aluminum material.

A wire harness of the present application may have the above-described terminal-equipped coated wire.

According to the present application, the anticorrosive agent is composed of the cured product of the curable resin, and the cured product has a crosslink density of $0.6\times10^{-5}$ (mol/cm$^3$) or more. Thus, sufficient oil resistance can be achieved, and it is possible to prevent oil from easily penetrating the coating of the anticorrosive agent, seeping from an adhesion interface and the like, and causing peeling of the anticorrosive agent and the resulting deterioration of anti-corrosion properties. On the other hand, the cured product has a crosslink density of $4\times10^{-4}$ (mol/cm$^3$) or less. Thus, there is no risk that the crosslink density is excessively high, causing the occurrence of cracking in the film of the anticorrosive agent. With the anticorrosive agent having a crosslink density within the above-described range, a terminal-equipped coated wire and a wire harness can be obtained in which the risk of the anti-corrosion performance deteriorating due to the adhesion of oil or other causes is eliminated, and a wire connecting portion has excellent anti-corrosion performance.

DESCRIPTION OF EXAMPLES

Figure 1:
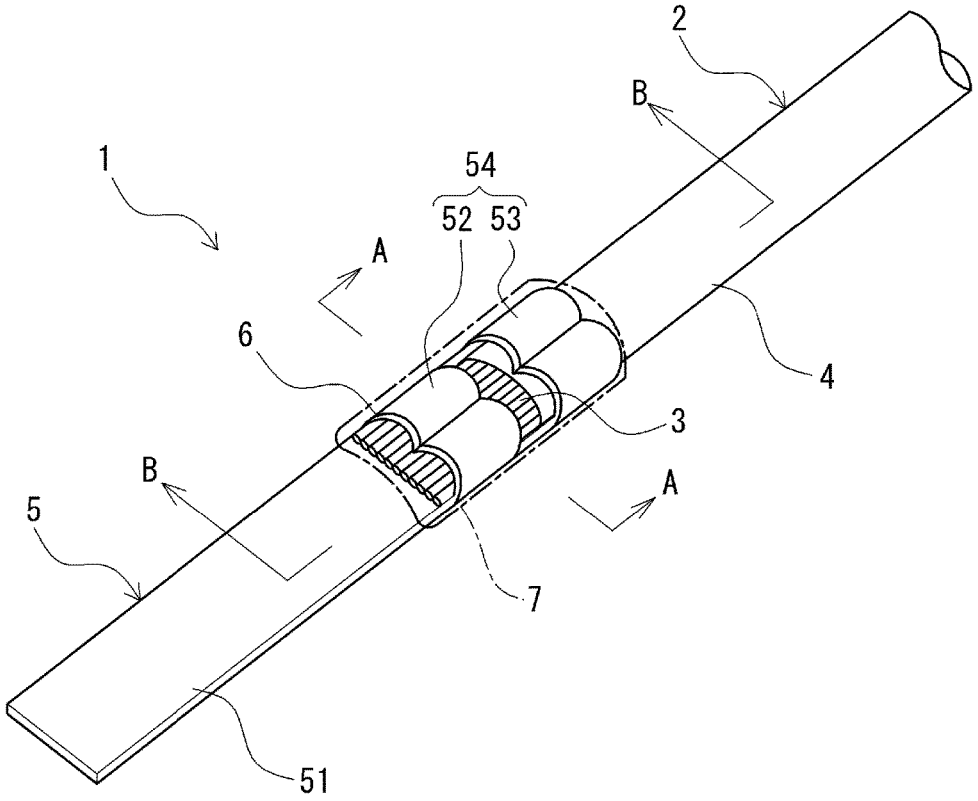
FIG. 1 is a perspective view showing an embodiment of a terminal-equipped coated wire.
Figure 2:
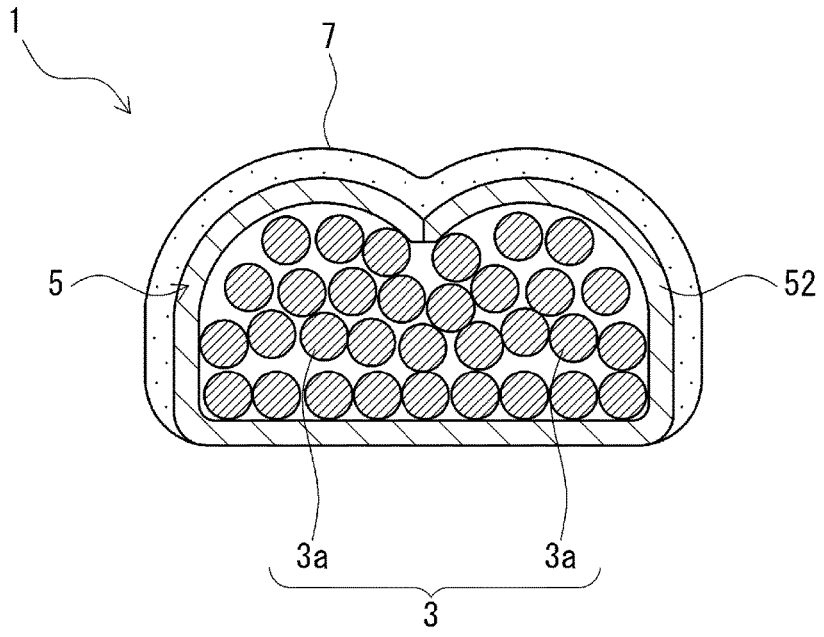
FIG. 2 is a vertical cross-sectional view taken along line A-A in FIG. 1.
Figure 3:
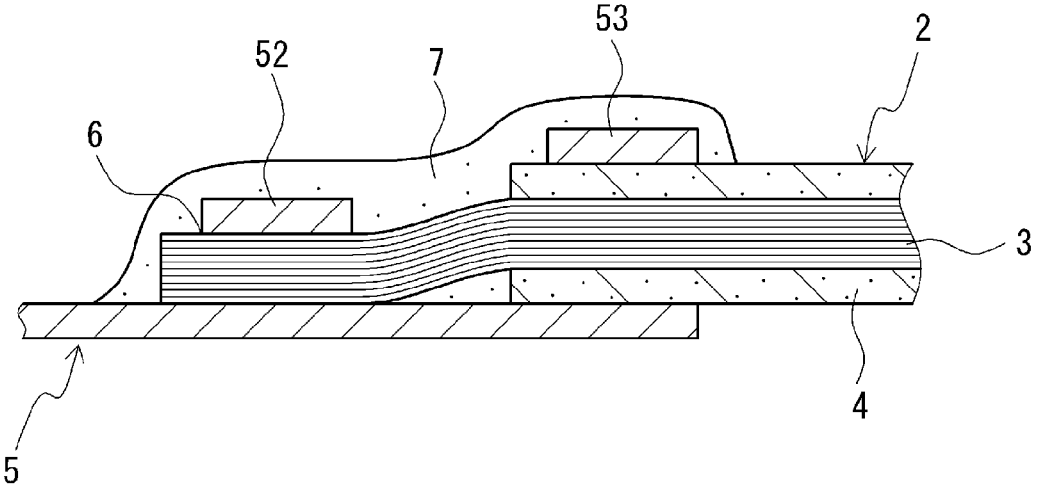
FIG. 3 is a vertical cross-sectional view taken along line B-B in FIG. 1.
Figure 4:
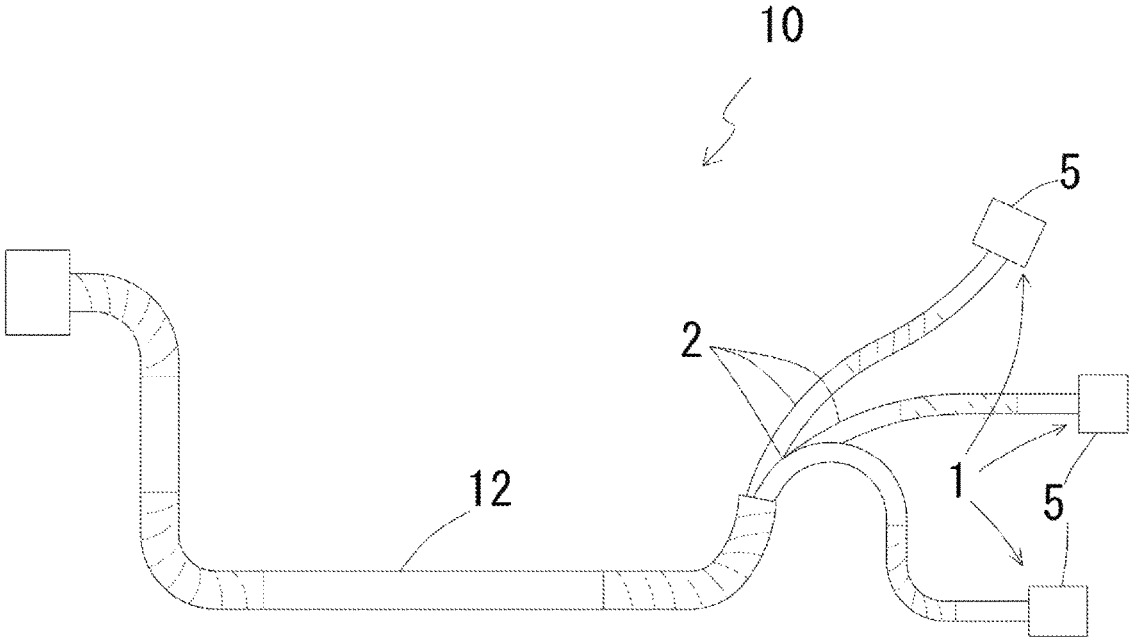
FIG. 4 is a schematic view of a wiring harness having an embodiment of a terminal-equipped coated wire, such as the one shown in FIG. 1.

Hereinafter, embodiments of the present application will be described in detail using the drawings. FIG. 1 is a perspective view showing an embodiment of a terminal-equipped coated wire, FIG. 2 is a vertical cross-sectional view taken along line A-A in FIG. 1, and FIG. 3 is a vertical cross-sectional view taken along line B-B in FIG. 2. As shown in FIGS. 1 to 3, in a terminal-equipped coated wire 1 of the present embodiment, a terminal fitting 5 made of a tin-plated copper material is crimped onto and connected to an end portion of a coated wire 2 in which a conductor 3 made of an aluminum alloy is coated with a coating material 4 made of a polyvinyl chloride resin.

A contact portion 6 between the conductor 3 and the terminal fitting 5 is coated and sealed with a coating of an anticorrosive agent 7. In the terminal-equipped wire shown in FIG. 1, the portion coated with the coating of the anticorrosive agent 7 is an area indicated by the dashed-dotted line. It should be noted that FIG. 1 shows a state where the coating of the anticorrosive 7 can be seen through. The anticorrosive agent 7 has the function of a protective film that prevents the intrusion of moisture and the like from the outside into the contact portion 6 between dissimilar metals, that is, the conductor 3 and the terminal fitting 5, and the resulting corrosion of a metal portion.

For the terminal fitting 5, a copper-based metal plate material which contains brass as the base material and whose surface is plated with tin is used. A predetermined shape corresponding to the terminal fitting in an opened-out state is stamped out from the metal plate material, and a barrel portion and the like thereof are folded. The thus produced terminal fitting is used. Therefore, an end surface of the terminal fitting 5 is not tin-plated, and brass is exposed at that end surface.

The terminal fitting 5 has a tab-like connecting portion 51 serving as a male terminal to be connected to a counterpart female terminal (not shown) and a barrel 54 (52, 53) for crimping the coated wire, the barrel being formed extending from a base end of the connecting portion 51. The barrel 54 is constituted by two crimp portions, namely, a wire barrel 52 provided on the connecting portion 51 side and an insulation barrel 53 provided on the conductor 3 side.

In the terminal-equipped coated wire 1, the conductor 3 that is exposed by stripping an end of the coated wire 2 is squeezed and crimped by the wire barrel 52. A portion where the conductor 3 and the terminal fitting 5 are crimped together constitutes the contact portion 6 (see FIGS. 2 and 3), and thus the conductor 3 and the terminal fitting 5 are electrically connected to each other. In the contact portion 6, the dissimilar metals, that is, the aluminum alloy of the conductor 3 and the tin-plated brass of the terminal fitting 5 are in contact with each other.

Moreover, the insulation barrel 53 of the terminal fitting 5 is squeezed and crimped onto the circumference of the coating material 4 of the coated wire 2. The crimp portion of the insulation barrel 53 serves as a wire fixing portion for fixing and holding the terminal fitting 5 to the end of the coated wire 2.

It should be noted that, in the present embodiment, for the sake of convenience, an end portion of the terminal fitting 5 on the connecting portion 51 side is referred to as a leading end, and an end portion of the terminal fitting 5 on the insulation barrel 53 side is referred to as a rear end. The leading end side is referred to as a front side of the terminal-equipped wire 1, and the rear end side is referred to as a rear side. Moreover, a side of the terminal fitting 5 onto which the wire is crimped is referred to as a top surface, and the opposite side of the terminal fitting 5 is referred to as a bottom surface.

In the terminal-equipped coated wire prior to the application of the anticorrosive agent 7, at the contact portion 6, which is a portion where the conductor 3 and the terminal are connected to each other, a portion of the conductor 3 is exposed to the outside. Then, as shown in FIGS. 1 to 3, the anticorrosive agent 7 is applied to the exposed portion of the conductor 3 so as to cover the above-described contact portion 6 of the terminal-equipped coated wire 1, and thus the exposed portion of the conductor 3 is covered with the coating of the anticorrosive agent 7.

The anticorrosive agent is composed of a cured product of a curable resin, and the cured product has a crosslink density within a range of $0.6\times10^{-5}$ to $4\times10^{-4}$ (mol/cm$^3$). A crosslink density of the cured product of $0.6\times10^{-5}$ (mol/cm$^3$) or more makes it possible to obtain sufficient oil resistance. At a crosslink density of less than $0.6\times10^{-5}$ (mol/cm$^3$), it is easy for oil to penetrate the coating of the anticorrosive agent, and therefore, the oil may seep from an adhesion interface and the like and cause peeling of the anticorrosive agent, resulting in the deterioration of anti-corrosion properties.

On the other hand, although the oil resistance increases as the crosslink density increases, at a crosslink density of more than $4\times10^{-4}$ (mol/cm$^3$), the crosslink density is excessively high, and there is a risk that cracking may occur in the coating of the anticorrosive agent. A crosslink density of the anticorrosive agent within the above-described range makes it possible to prevent swelling of the anticorrosive agent with oil and peeling at the interface.

The above-described crosslink density is obtained by measuring the equilibrium modulus of elasticity from the dynamic viscoelasticity of the above-described cured product and calculating an equation (1) below:

$$\rho=E/(3RT) \quad (1)$$

in the equation (1), ρ represents the crosslink density (mol/cm$^3$), E represents the modulus of elasticity (MPa), R represents the gas constant (8.31 J/mol·k), and T represents the absolute temperature (K).

The modulus of elasticity E refers to an equilibrium modulus of elasticity that is obtained from a measurement value of the dynamic viscoelasticity of the cured product that is measured by using a viscoelasticity measuring apparatus. The dynamic viscoelasticity can be measured with a commercially-available solid viscoelasticity measuring apparatus by periodically distorting a test piece and detecting the resulting stress and phase difference. With respect to specific measurement conditions for the dynamic viscoelasticity, the equilibrium modulus of elasticity was measured by using a "Q800" manufactured by TA Instruments. The measurement conditions were as follows: measurement was performed in a tensed mode, the rate of temperature rise was 3° C./min, the temperature range was −60° C. to +200° C., and the frequency was 1 Hz. A measurement value at 150° C. (423K) out of measurement values within the above-described temperature range was used as the equilibrium modulus of elasticity. The value at 150° C. was used because this temperature is 30° C. or more higher than the temperature at which the modulus of elasticity is constant, and thus a sufficient equilibrium is reached.

It is preferable that the cured product of the anticorrosive agent 7 has a tensile shear adhesive strength to the metal of the terminal fitting of 0.5 MPa or more after an oil resistance test. The tensile shear adhesive strength refers to a value that is obtained by measuring the tensile shear adhesive strength of a test piece in which an Sn-plated copper plate conforming to JIS K6850 and a glass plate are bonded to each other as adherends using the anticorrosive agent. The oil resistance test of the test piece was performed by immersing the test piece in a gear oil specified in JIS K2219 at 20° C. for 8 hours.

A shear adhesive strength after the oil resistance test of 0.5 MPa or more makes it possible to maintain the adhesiveness at an interface of the anticorrosive agent after adhesion of oil and prevent interfacial peeling. As a result, the intrusion of water from the interface and the resulting corrosion can be favorably prevented.

Various curable resins such as ultraviolet curable resins, thermosetting resins, and two-component curable resins can be used as the curable resin used for the anticorrosive agent 7. For example, an adhesive composition (hereinafter sometimes referred to as an ultraviolet curable adhesive) of an ultraviolet curable acrylic resin may be used as the curable resin. After having been applied, the ultraviolet curable adhesive can be cured to form a cured product through ultraviolet irradiation or heating.

In the case where a cured product of an ultraviolet curable acrylic resin is used as the anticorrosive agent 7, the anticorrosive agent 7, even when having a low viscosity, can be prevented from flowing into the leading end portion by irradiating the anticorrosive agent 7 with ultraviolet rays and thereby quickly cure the composition.

It is preferable that the ultraviolet curable adhesive used for the anticorrosive agent 7 has a viscosity within a range of 1000 to 4000 mPa·s at room temperature in view of the ease of penetration through gaps of the conductor and the like during application.

The ultraviolet curable adhesive includes, for example, an acrylate oligomer, an acrylate monomer, a photopolymerization initiator, a thermal polymerization initiator, and the like.

Various types of acrylate oligomers that are usually used as an ultraviolet curable adhesive and that can exhibit the function of an adhesive through ultraviolet curing can be used as the above-described acrylate oligomer. The use of an urethane acrylate oligomer as the acrylate oligomer is preferable in that adjustment of the viscosity is easy, the adhesiveness is favorable, adjustment of the properties is easy, and so on. A known urethane acrylate that is used for an ultraviolet curable adhesive can be used as the urethane acrylate oligomer.

The photopolymerization initiator is not limited as long as it is a compound that can absorb ultraviolet rays and initiate radical polymerization, and a conventionally known compound can be used.

Moreover, an acrylate monomer such as isobornyl (meth) acrylate may also be mixed in the ultraviolet curable adhesive.

In addition to the above-described components, other additives may also be mixed in the ultraviolet curable adhesive without impairing the object of the present application. Examples of the other additives include liquid-property adjusting agents, such as an anti-aging agent, an adhesion promoter, a corrosion inhibitor, a thixotropic agent, and a leveling agent, as well as a pigment, a dye, an inorganic filler, and the like.

The anticorrosive agent 7 that is obtained by curing the above-described ultraviolet curable adhesive may be a transparent resin or may be a semitransparent resin.

It is preferable that the anticorrosive agent 7 is applied such that the coating thereof has a thickness within a range of 0.01 to 3 mm. An excessively large thickness of the coating of the anticorrosive agent 7 may make it difficult to insert the terminal fitting 5 into a connector of a counterpart terminal. On the other hand, an excessively small thickness of the coating of the anticorrosive agent 7 may result in insufficient anti-corrosion performance.

When applying the ultraviolet curable adhesive of the anticorrosive agent 7 to the contact portion between the conductor and the terminal fitting, a known means such as a dropping process, an application process, an extrusion process, or the like can be used as the application method. Moreover, when applying the ultraviolet curable adhesive, temperature control of the anticorrosive agent may also be performed through heating, cooling, and the like.

At least the exposed portion of the conductor 3 is completely coated with the anticorrosive agent 7. Furthermore, the leading end side of the coated wire 2 is coated with the anticorrosive agent 7 such that the anticorrosive agent 7 slightly protrudes from the leading end of the conductor 3 to the connecting portion 51 side of the terminal fitting 5. The exposed portion of the conductor 3 of the coated wire 2 is covered by the anticorrosive agent 7 and is not exposed to the outside. Moreover, on the coated wire 2 side, the surface of the insulation barrel 53 and a portion of the coating material 4 are coated with the anticorrosive agent 7. The coating material 4 side of the end surface of the insulation barrel 53 is coated with the anticorrosive agent 7.

It is preferable that the tensile shear adhesive strength between the anticorrosive agent 7 and the coating material 4 is 0.5 MPa or more. Also, it is preferable that the tensile shear adhesive strength between the anticorrosive agent 7 and the terminal fitting 5 is 0.5 MPa or more. To achieve a tensile shear adhesive strength of the anticorrosive agent of 0.5 MPa or more, the type and the like of the urethane acrylate used for the ultraviolet curable adhesive can be selected as appropriate in accordance with an adherend. A tensile shear adhesive strength of the anticorrosive agent within the above-described range makes it possible to prevent the coating material from contracting, for example, after the terminal-equipped wire is left to stand at a high temperature, thereby causing a gap to form and resulting deterioration of the anti-corrosion performance. The above-described tensile shear adhesive strength refers to a value that is measured at room temperature in conformity with JIS K6850.

A stranded wire composed of a plurality of elemental wires 3*a* that are twisted together is used as the conductor 3 of the coated wire 2. In this case, the stranded wire may be composed of a single type of metal elemental wire or may be composed of two or more types of metal elemental wires. Moreover, the stranded wire may also include an elemental wire made of an organic fiber, for example, in addition to the metal elemental wires. It should be noted that being composed of a single type of metal elemental wire means that all of the metal elemental wires composing the stranded wire are made of the same metal material, and being composed of two or more types of metal elemental wires means that the stranded wire includes metal elemental wires made of different metal materials. The stranded wire may also include a reinforcing wire (tension member) for reinforcing the coated wire, for example.

Examples of the material for the metal elemental wires composing the conductor 3 include, in addition to an aluminum alloy, copper, a copper alloy, and aluminum, or the aluminum alloy, copper, the copper alloy, and aluminum that are plated with various plating materials. Moreover, examples of the material for a metal elemental wire serving as the reinforcing wire include a copper alloy, titanium, tungsten, and stainless steel. Moreover, examples of the organic fiber serving as the reinforcing wire include Kevlar. From the standpoint of reducing the wire weight, for example, it is preferable to use aluminum or an aluminum alloy for the metal elemental wires of the conductor 3.

Examples of the material for the coating material 4 of the coated wire 2 include rubber, polyolefin, a polyvinyl chloride resin (PVC), and a thermoplastic elastomer. These materials may be used alone or may be used in combination of two or more. Various additives may also be added to the material for the coating material 4 as appropriate. Examples of such additives include a flame retardant, a filler, and a coloring agent.

With regard to the material (material for the base material) for the terminal fitting 5, apart from brass, various copper alloys, copper, and the like can also be used. Moreover, a portion (e.g., a contact) or the entirety of the surface of the terminal fitting 5 may also be plated with various metals such as tin, nickel, and gold.

To manufacture the terminal-equipped coated wire 1, first, the coating material 4 at the leading end of the coated wire 2 is stripped off to expose a predetermined length of the conductor 3 at the end of the coated wire 2. The terminal fitting 5, which is stamped out from the plated base material and then subjected to bending and the like as described above, is squeezed and crimped onto the above-described end of the coated wire 2. The wire barrel 52 of the terminal fitting is crimped onto the conductor 3, and the insulation barrel 53 is crimped onto the coating material 4, thereby connecting the conductor 3 and the terminal fitting 5 to each other. Then, the anticorrosive agent is applied to a predetermined area containing the contact portion between the conductor 3 and the terminal fitting 5. Then, the anticorrosive agent is irradiated with ultraviolet rays to cure an area reached by the irradiation light. As a result of being irradiated with ultraviolet rays, the anticorrosive agent 7 is cured to such an extent that the ultraviolet curable adhesive is no longer flowable. Thus, the ultraviolet curable adhesive can be prevented from flowing to the leading end side. Furthermore, the resin in an uncured portion where ultraviolet rays did not reach is heated and cured through heating at a predetermined temperature for a predetermined period of time. Thus, the terminal-equipped coated wire 1 is obtained in which the contact portion 6 between the conductor 3 and the terminal fitting 5 is sealed with the anticorrosive agent 7 in which the ultraviolet curable adhesive is cured.

Hereinafter, a wire harness 10 of the present application will be described. The wire harness 10 is formed by tying up, into a bundle 12, a plurality of coated wires 2 including the above-described terminal-equipped coated wire 1. In the wire harness 10, at least one of the coated wires 2 may be the terminal-equipped coated wire 1, or all of the coated wires may be the terminal-equipped coated wires 1.

In the wire harness, the plurality of coated wires may be tied up by winding a tape therearound or may be tied up by being sheathed with a sheath component such as a round tube, a corrugated tube, a protector, or the like.

The wire harness is preferable a wire harness to be routed in a vehicle such as an automobile, and is particularly preferable as a wire harness to be routed in an engine room or the inside of a vehicle, in a region that may be exposed to water. In the case where the wire harness is routed in such a place, even when the wire harness is exposed to a high temperature in a state in which oil such as engine oil adheres to the wire harness, the anti-corrosion performance of the anticorrosive agent can be maintained, because the anticorrosive agent 7 has favorable oil resistance.

EXAMPLES

Hereinafter, examples and comparative examples will be described. It should be noted that the present invention is not limited by these examples.

Examples 1 to 5 and Comparative Examples 1 and 2

Ultraviolet curable adhesives containing an acrylate oligomer were used as anticorrosive agents. Terminal-equipped wires of Examples 1 to 5 and Comparative Examples 1 and 2 were produced by sealing exposed conductor portions of the terminal-equipped wires by using cured products having varying crosslink densities as shown in Table 1. Table 1 also shows the crosslink density, the equilibrium modulus of elasticity, and the tensile shear adhesive strength (prior to and after an oil resistant test) of the anticorrosive agents. The crosslink density and the equilibrium modulus of elasticity were measured under the above-described conditions. The testing method for the tensile shear adhesive strength was as described below.

Tensile Shear Adhesive Strength Test

Size of test piece: 25 mm×80 mm×0.5 mm thickness

Bonding area: 25 mm×12.5 mm

Pulling speed: 100 mm/min

Material for test piece: tin-plated brass plate×glass plate

Composites having the following compositions were used as the anticorrosive agents respectively used in the examples and comparative examples. The crosslink density of the anticorrosive agents was adjusted by changing the mixing amount of oligomer.

Composition of Anticorrosive Agent

Acrylic monomer (manufactured by Kyoeisha Chemical Co., Ltd., trade name "LIGHT ACRYLATE IB-XA")

Photopolymerization initiator (manufactured by BASF, tradename "IRGACURE 184")

Oligomer (manufactured by Kyoeisha Chemical Co. Ltd., trade name "LIGHT ACRYLATE TMP-A": the mixing amounts were as follows.

Example 1: 30 parts by mass

Example 2: 25 parts by mass

Example 3: 20 parts by mass

Example 4: 15 parts by mass

Example 5: 10 parts by mass

Comparative Example 1: 5 parts by mass

Comparative Example 2: 45 parts by mass

An oil resistance test was performed using the terminal-equipped wires of Examples 1 to 5 and Comparative Examples 1 and 2, and the external appearances were observed to evaluate the anti-corrosion performance. Moreover, a thermal test was performed, and surface cracking was observed. Table 1 shows the results of the tests. The methods for performing these tests were as described below.

Method for Performing Oil Resistance Test

In conformity with JIS K6858, the condition of the terminal after the terminal-equipped wire was immersed in oil was evaluated. The evaluation was performed based on the following criteria: when swelling and peeling of the anticorrosive agent did not occur, the condition of the terminal was evaluated as excellent; when peeling did not occur even though swelling occurred, the condition of the terminal was evaluated as favorable; and when both swelling and peeling occurred, the condition of the terminal was evaluated as poor. Moreover, in order to observe a change in the mass of the anticorrosive agent after the oil resistant test, a dumbbell-shaped test piece (No. 6 dumbbell-shaped piece conforming to JIS K6251, 1 mm thick) was produced from a sheet of the anticorrosive agent, then, the oil resistant test was performed under the same conditions as described above, the weight of the dumbbell-shaped test piece was measured prior to and after the test, and the rate of an increase in the mass after the test relative to the mass prior to the test was obtained as the mass increase rate (%). The mass increase rate was an evaluation of the rate at which the anticorrosive agent absorbed the oil.

Method for Performing Thermal Test

The thermal test was performed in the following manner. In a single cycle, the terminal-equipped wire was kept at +125° C. for 1 hour and at −45° C. for 1 hour. This cycle was repeated 500 times, and after that, the external appearance of the anticorrosive agent of the terminal-equipped wire was observed. When no cracking was observed in the external appearance, the external appearance was evaluated as favorable, and when cracking was observed in the external appearance, the external appearance was evaluated as poor.

Regarding Test Results

As shown in Table 1, in Examples 1 to 5, the crosslink density was within the range specified in the present application, and the oil resistance and the adhesive strength were also favorable. In contrast, in Comparative Example 1, the crosslink density was less than $0.6\times10^{-5}$ (mol/cm$^3$), and thus the oil resistance was unsatisfactory. Moreover, in Comparative Example 2, the crosslink density was more than $4\times10^{-4}$ (mol/cm$^3$), and thus the external appearance after the thermal test was poor.

TABLE 1

| | | Examples | | | | | Comparative Examples | |
|---|---|---|---|---|---|---|---|---|
| | | 1 | 2 | 3 | 4 | 5 | 1 | 2 |
| Properties of anticorrosive agent | | | | | | | | |
| Crosslink density (mol/cm$^3$) | | $3\times10^{-4}$ | $3\times10^{-5}$ | $2.5\times10^{-5}$ | $1.0\times10^{-5}$ | $0.8\times10^{-5}$ | $0.5\times10^{-5}$ | $5\times10^{-4}$ |
| Equilibrium modulus of elasticity (150° C.) (MPa) | | 3.2 | 0.31 | 0.26 | 0.11 | 0.08 | 0.05 | 5.3 |
| Test results | | | | | | | | |
| Adhesive strength | Initial (MPa) | 10 | 4 | 4 | 3 | 3 | 2.5 | 15 |
| | After oil resistant test (MPa) | 8 | 3 | 3 | 1 | 0.5 | 0.2 | 5 |
| Oil resistance test (corrosion of terminal) | | Excellent | Excellent | Excellent | Favorable | Favorable | Poor | Excellent |
| Mass increase rate after oil resistant test (%) | | 3 | 5 | 8 | 14 | 18 | 20 | 3 |
| Thermal test (cracking in external appearance) | | Favorable | Favorable | Favorable | Favorable | Favorable | Favorable | Poor |

Although embodiments have been described in detail above, the invention is not limited to the foregoing embodiments, and various modifications are possible without departing from the gist of the invention.

For example, with regard to the terminal-equipped coated wire 1 of the foregoing embodiment, although an example in which a tab-like male terminal is used as the terminal fitting has been described, the present invention is not limited to this. For example, a terminal-equipped coated wire in which a female terminal is used as the terminal fitting may also be adopted. Moreover, a tuning fork terminal or the like may also be used as the terminal fitting.

The terminal fitting 5 may be a terminal which does not have the insulation barrel and in which the conductor and the coating material are crimped by only a single wire barrel, and the rear end of the wire barrel is exposed to the outside.

Moreover, the barrel may also be constituted only by an insulation barrel. In that case, pressure contact resistance welding, ultrasonic welding, soldering, and other methods may be used as the method for connecting the conductor and the terminal fitting to each other. Moreover, although a stranded wire is used as the conductor in the foregoing embodiment, a single core wire may also be used as the conductor.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A terminal-equipped coated wire comprising:

an exposed conductor portion at an end portion of a coated wire in which a conductor is coated with a coating material, the coating material being peeled off and the conductor being exposed at the exposed conductor portion;

a terminal fitting connected to the conductor at the exposed conductor portion; and an anticorrosive agent with which a contact portion between the conductor and the terminal fitting is sealed, wherein the anticorrosive agent is composed of a cured product of a curable resin, the cured product having a crosslink density within a range of $0.6\times10^{-5}$ to $4\times10^{-4}$ (mol/cm$^3$), the crosslink density is obtained by measuring an equilibrium modulus of elasticity from a dynamic viscoelasticity of the cured product and calculating an equation (1) below, and the cured product has a tensile shear adhesive strength to a metal of 0.5 MPa or more after an oil resistance test:

$$\rho = E/(3RT) \quad (1)$$

in the equation (1), ρ represents the crosslink density (mol/cm$^3$), E represents an equilibrium modulus of elasticity (MPa), R represents a gas constant (8.31 J/mol·k), and T represents an absolute temperature (K).

2. The terminal-equipped coated wire according to claim 1, wherein the curable resin is an ultraviolet curable acrylic resin.

3. The terminal-equipped coated wire according to claim 1, wherein the terminal fitting is made of a copper material whose surface is plated with tin.

4. The terminal-equipped coated wire according to claim 1, wherein the conductor has an elemental wire made of an aluminum material.

5. A wire harness comprising the terminal-equipped coated wire according to claim 1.

* * * * *